United States Patent [19]

Graebe, Jr.

[11] Patent Number: 4,833,457

[45] Date of Patent: May 23, 1989

[54] IMMERSION CONTROL DEVICE AND ASSOCIATED ALARM SYSTEM

[76] Inventor: William F. Graebe, Jr., 208 Yorktown Dr., Collinsville, Ill. 62234

[21] Appl. No.: 123,820

[22] Filed: Nov. 23, 1987

[51] Int. Cl.[4] ..... G08B 21/00

[52] U.S. Cl. ..... 340/626; 340/667; 200/85 A; 5/455

[58] Field of Search ..... 340/626, 666, 667, 58; 5/453, 449, 452, 454, 455, 456; 200/81 R, 85 R, 85 A

[56] References Cited

U.S. PATENT DOCUMENTS

| | | | |
|---|---|---|---|
| Re. 28,754 | 3/1976 | Cook et al. | 200/85 R X |
| 3,533,095 | 10/1970 | Collins | 200/85 R X |
| 3,631,438 | 12/1971 | Lewin | 340/573 |
| 3,860,773 | 1/1975 | Fontaine | 200/85 R |
| 4,020,482 | 4/1977 | Feldl | 200/85 R X |
| 4,068,334 | 1/1978 | Randall | 5/453 |
| 4,086,458 | 4/1978 | Dickey | 200/85 R |
| 4,172,216 | 10/1979 | O'Shea | 200/85 R |
| 4,638,307 | 1/1987 | Swartout | 340/666 |

*Primary Examiner*—Joseph A. Orsino
*Assistant Examiner*—Jeffery A. Hofsass

[57] ABSTRACT

An immersion control device. The device includes a fluid filled manifold and a fluid filled support device. Fluid pressure in the fluid filled support device equals fluid pressure in the fluid manifold notwithstanding respective fluid volumes. Immersion depth is controlled by increasing or decreasing fluid pressure. A fluid pressure regulator operates manually or automatically in response to a feedback of a fluid pressure change. Regulating members and spaced apart conductors or conductive stages can be used to provide feedback and activate an alarm, the fluid pressure regulator or both.

15 Claims, 4 Drawing Sheets

FIG. 3.
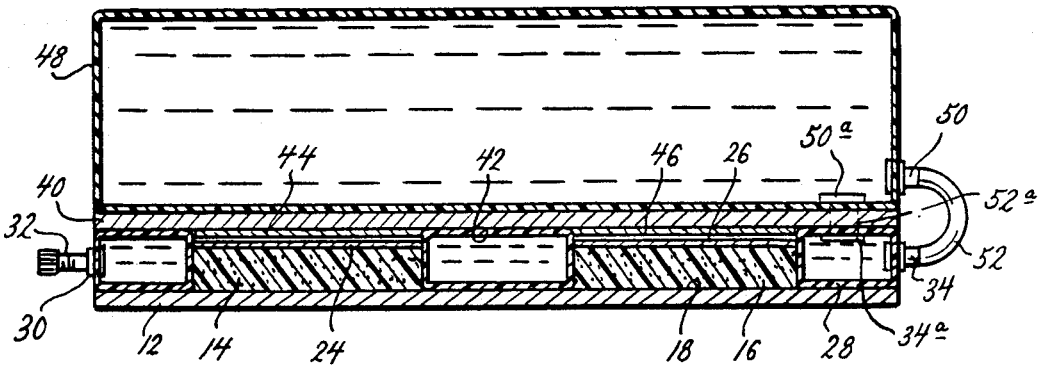
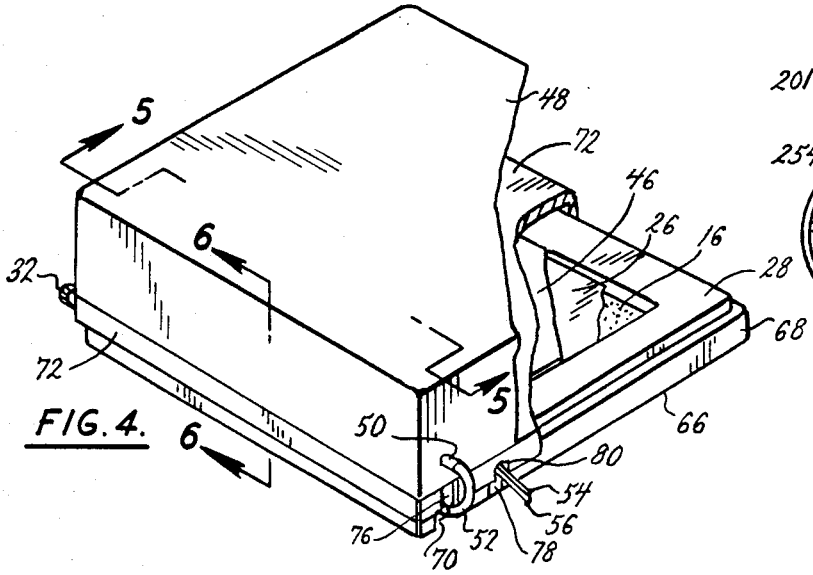
FIG. 4.
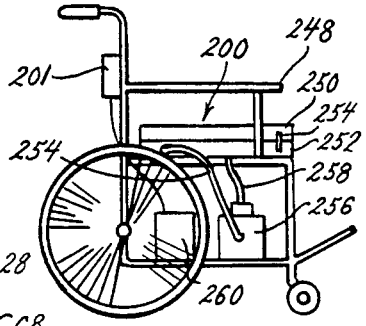
FIG. 17.
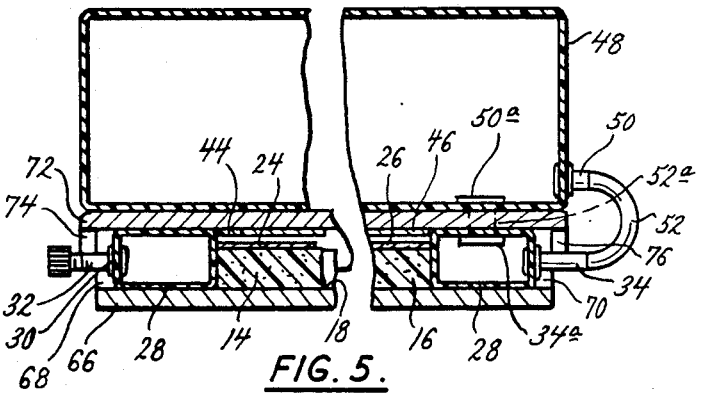
FIG. 5.
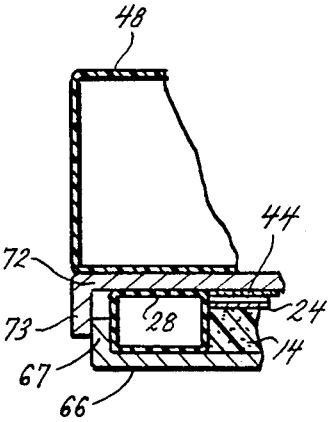
FIG. 6.

FIG. 7.
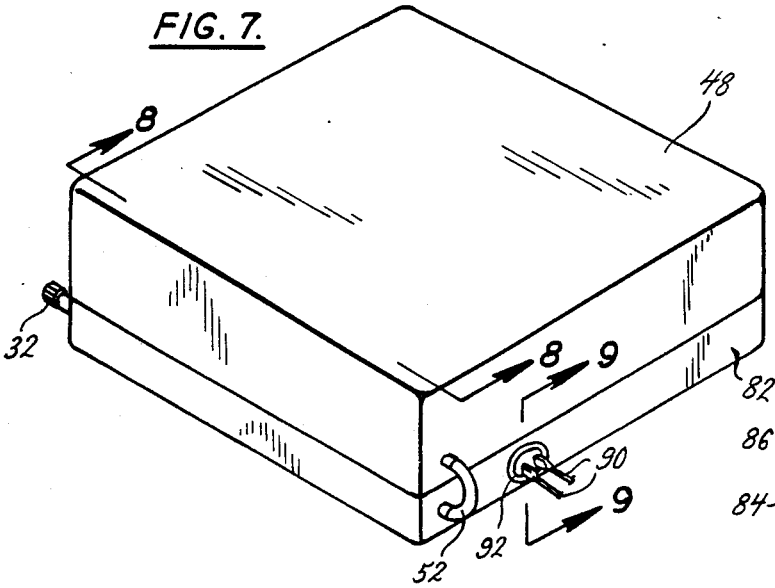
FIG. 9.
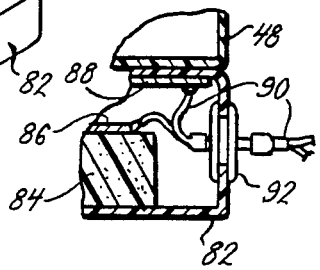
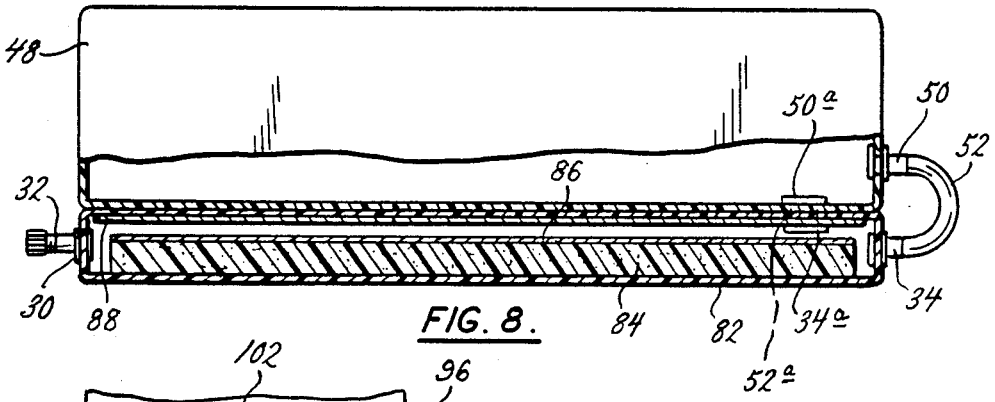
FIG. 8.
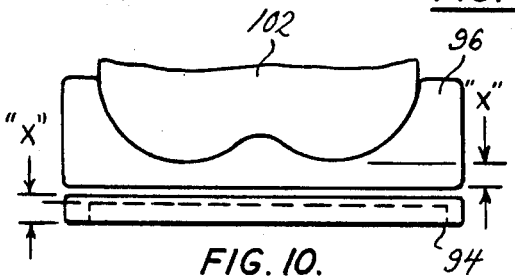
FIG. 10.
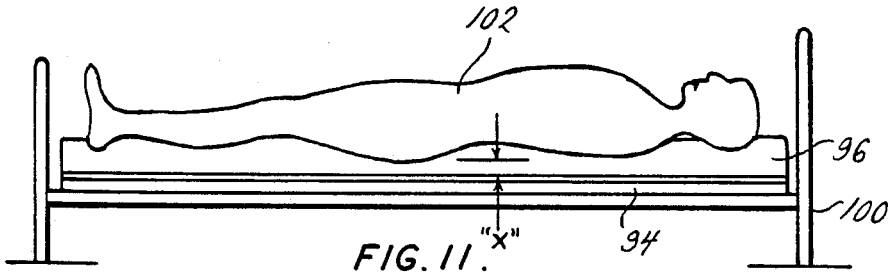
FIG. 11.

FIG. 12.
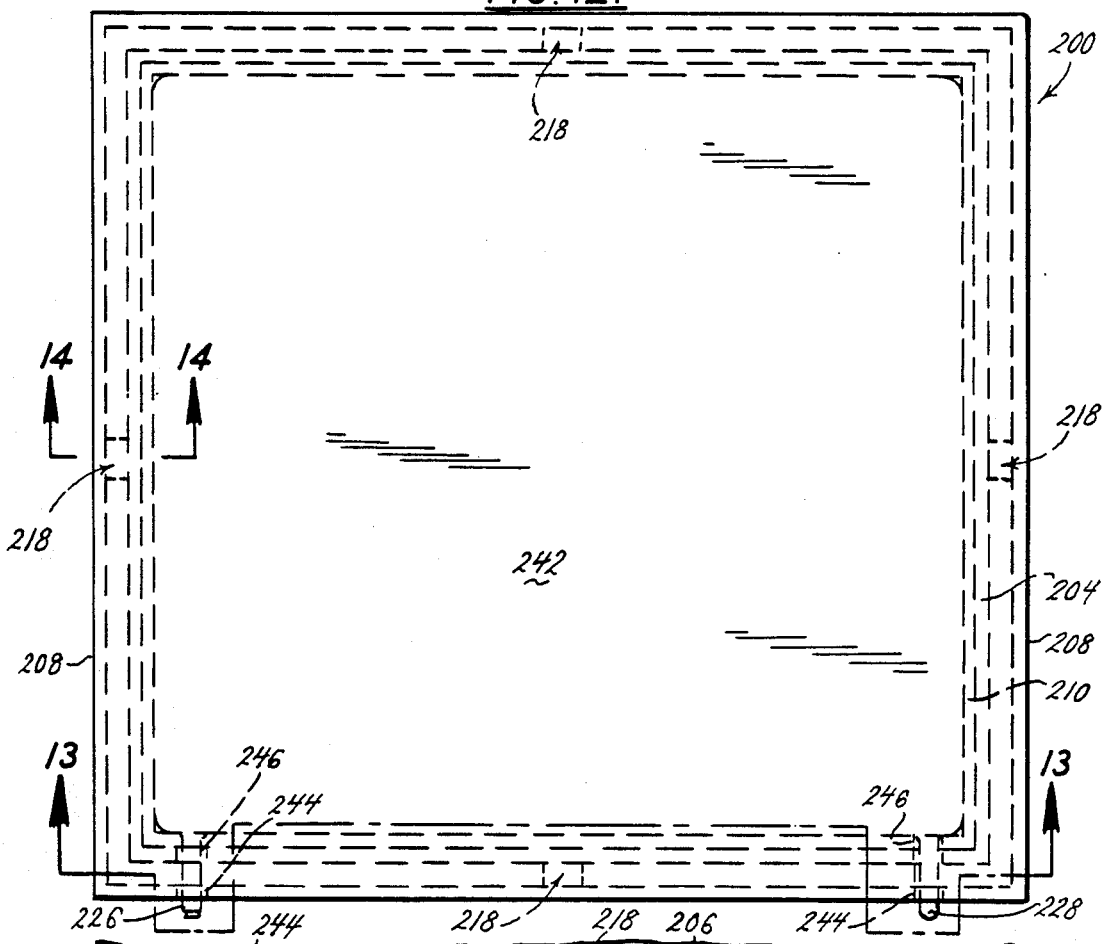
FIG. 13.
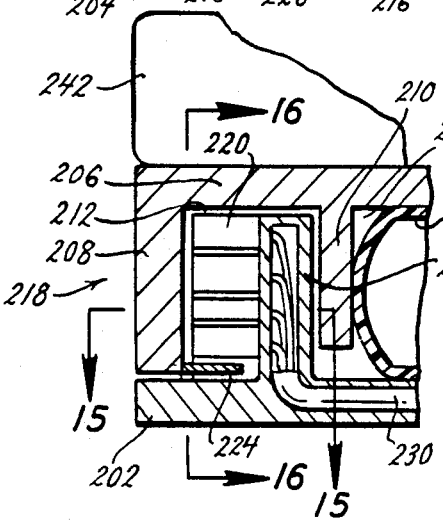
FIG. 14.
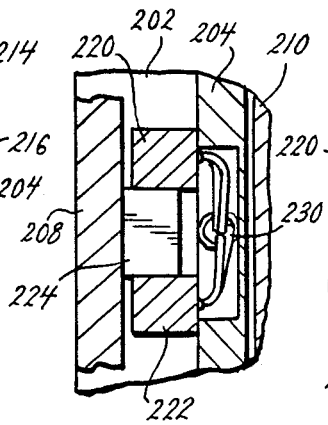
FIG. 15.
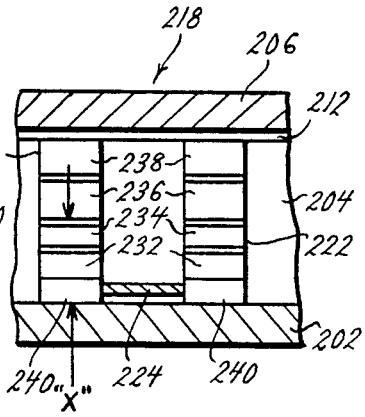
FIG. 16.

IMMERSION CONTROL DEVICE AND ASSOCIATED ALARM SYSTEM

BACKGROUND OF THE INVENTION:

This invention relates generally to an immersion control device and associated alarm that establishes a fluid pressure within a fluid filled cushion or mattress and detects a fluid pressure change within the fluid filled cushion, and more particularly, to a device for establishing a fluid pressure and then detecting a fluid pressure change within a fluid filled cushion or mattress used to support an object or an individual in a bed, a wheelchair or other seat or support. This invention provides means to regulate the fluid pressure in the fluid filled cushion or mattress in response to the detected fluid pressure change and, if desired, sound a suitable alarm in response to an over or under pressure condition.

The device of the present invention provides means for establishing the proper or desired depth in which to immerse an individual into a fluid filled device (such as air filled or water filled cushion or mattress), for example a wheelchair cushion or a mattress without "bottoming out". Proper immersion into the cushion, mattress or support device as it may be referred to hereinafter, increases the amount of the surface area of the skin of an individual or support area of an object that is contacted by the fluid filled cushion or mattress or support device. The greater the amount of surface area that can be used to support an object or an individual the greater the reduction in a peak and average pressures on the object or on the skin of the individual. In the case of an individual having decubitus ulcers or pressure sores, reduction of these peak and average pressures exerted on the skin is of primary importance. In the case of fragile or volatile objects reduction of these peak and average pressures exerted on the object can be important to protect against breakage or other damage in the event of a bump or shock to the object. It is desired to minimize the peak and average pressures.

The device of the present invention is particularly useful for handicapped individuals confined to wheelchairs or beds. The present invention is generally applicable as part of a seat support system in automobiles, trucks, airplanes, or other supports in which one remains seated for extended time periods. It will be understood that while the device of the present invention has numerous applications the following description will be directed to preferred embodiments of the invention as intended for use by a handicapped, paralyzed or partially paralyzed individual.

The presently available devices attempt to immerse the individual as deeply as possible. However, a desired immersion without "bottoming out" can only be arrived at presently by trial and error.

Presently, the only way of determining that the proper depth of immersion into the fluid filled cushion or mattress has been achieved is to insert a finger, fingers or the entire hand under the position of the bony prominences of the body, such as the ischial tuberosities in the buttocks. This method is not easy for a handicapped individual to accomplish and often not possible at all because of physical impairments. Even this crude and inaccurate method is often not understood by care givers and is carried out differently by individual care givers generally resulting in many different immersion depths and with the resultant ranges of fluid pressures in the fluid filled cushion or mattress. These ranges of fluid pressures result in various performance ranges of peak and average contact pressures on the skin of the individual supported by the fluid filled cushion or mattress.

Another problem, particularly with respect to air filled cushions, is the leakage of minute amounts of air. Air leakage can cause the immersed individual to "bottom out" in the device and lose all of the benefits derived from the air filled support device. Paralyzed individuals are particularly susceptible since they could have no sensation in the buttocks and do not realize that they are resting not on the support device but on an underlying support surface and that they have "bottomed out".

In the conventional devices alarms have been provided to signal the departure of a patient from a hospital bed, U.S. Pat. No. Re. 28,754 for bed egress alarm circuit reissued Mar. 30, 1976 to Cook et al, Reissue of U.S. Pat. No. 3,852,736, issued Dec. 3, 1974; and an air inflated flexible bag has been provided to be placed below the mattress of a hospital or nursing home bed and connected to a pressure actuated electrical switch signal at a remote attendant's station, to signal removal of a patient's weight from the mattress, U.S. Pat. No. 4,020,482 issued Apr. 26, 1977 to Feldl for patient monitor. An inflatable pad is disclosed in U.S. Pat. No. 3,533,095 issued Oct. 6, 1970 to Collins for inflatable pad with alarm consisting of an inflatable pad to which is secured a pressure switch maintained in a line connected to a power source with an indicator and buzzer activated when the pressure switch plunger is advanced by the placement of a weight on the inflatable pad and closing a circuit to activate the buzzer and indicator light. Another mattress and alarm combination is shown in U.S. Pat. No. 3,631,438 issued Dec. 28, 1971 to Lewin for apnoea alarms comprising a compartmented air mattress with individual compartments connected to a common chamber containing an anemometer connected to an electric circuit which gives an alarm after a pre-set time if there is no airflow over a katharometer normally caused by the movement of the mattress as the result of a breathing baby lying on it.

In the conventional devices pressure sensitive switches have been provided. U.S. Pat. No. 4,172,216 issued on Oct. 23, 1979 to O'Shea for pressure sensitive switch discloses a resilient insulative layer of a plastic foam material sandwiched between a dimpled carbon powder loaded plastic foam pad in which the dimples extend through holes in the insulative layer and are intended to be placed under a bed mattress as a mattress-switch indicating electrically by means of contact between the plastic sheet and the foam pad the presence of an occupant in the bed or his absence by lack of such contact. U.S. Pat. No. 3,860,773 issued Jan. 14, 1975 to Fontaine for composite seat and switch with recessed contacting sheet discloses a base panel, a resilient pad, a pair of contacting sheets and a seat cover integrated together with one of the contacting sheets in a recess in either the pad or the panel and there between so as to be separated from the other contacting sheet, wherein the contacting sheets close when a person sits on the seat cover and open when the person leaves as a result of the resilient action of the pad. U.S. Pat. No. 4,086,458 issued on Apr. 25, 1978 to Dickey for electrical switch for use by the disabled discloses a switch comprising a resilient contact assembly including a pair of electrical conducting members in a housing in which the conducting members are maintained out of electrical contact with each other by means associated with the assembly such that application of pressure to the housing closes the switch.

In the conventional devices, such as alarms and pressure sensitive switches, a signal is generated in response to a physical action such as getting in or out of a bed. The conventional devices do not provide for any corrective action in response to the signal. The conventional devices do not provide for the adjustable support of an individual confined to a bed or wheelchair.

The immersion control device and associated alarm of the present invention solves these and other problems in a manner not disclosed in the known prior art.

SUMMARY OF THE INVENTION

The immersion control device and associated alarm of the present invention provides a fluid filled support device including a fluid filled cushion or mattress and a fluid manifold located below and supporting the fluid filled support device. A fluid interconnection provides a fluid passage between the fluid filled support device and the fluid manifold. The fluid manifold is preferably a flexible or expandable material such as a rubber or a vinyl material. A sensing means is provided which includes a first conductor, and a second conductor. A predetermined or measured movement between the spaced apart conductors corresponds to a change in the fluid pressure in the fluid filled support device. A fluid pressure regulator means may be provided for regulating the fluid pressure, that is, increasing or decreasing the fluid pressure. An alarm means can provide a signal corresponding to the movement of the sensing means.

It is an aspect of this invention that the device provides a fluid filled support device to support an individual or object so as to establish and then maintain a desired pressure on the individual or object as a result of the supporting contact between the individual or object and the fluid filled support device.

It is an aspect of this invention that the device provides a support device including a fluid filled cushion or mattress to support an individual user of the device, for example, a person confined to a bed or a wheelchair.

It is another aspect of this invention that a fluid manifold is provided that supports a fluid filled cushion or mattress and the manifold and cushion or mattress are interconnected by a fluid passage.

It is another aspect of this invention that the device provides a sensing means including two or more spaced apart conductors. Movement of one or more conductors can place the conductors in either a spaced apart position or in a contacting position.

It is another aspect of this invention that a fluid supply and exhaust connection is provided for the fluid manifold in order to change the fluid pressure in the immersion control device.

It is another aspect of the invention to provide a constant pre-determined immersion depth for each individual user.

It is another aspect of the present invention that the device provides for equal fluid pressure in the fluid filled cushion or mattress and the fluid manifold notwithstanding their respective fluid volumes.

It is another aspect of the present invention that a more sophisticated sensing means is provided. The sensing means generally includes a plurality of spaced apart conductive stages and a conductor that is movable between the spaced apart stages.

These and other aspects and features of the present invention will be better understood and appreciated from the following detailed description of embodiments thereof selected for the purpose of illustration and shown in the accompanying drawings.

BRIEF DESCRIPTION OF THE DRAWINGS:

FIG. 2 is an exploded view of the embodiment shown in

FIG. 3 is a cross-sectional view taken along line 3—3 of FIG. 1;

FIG. 4 is a fragmentary perspective view of another embodiment of the present invention;

FIG. 5 is a fragmentary cross-sectional view taken along line 5—5 of FIG. 4;

FIG. 6 is a partial cross-sectional view taken along line 6—6 of FIG. 4;

FIG. 7 is a perspective view of another embodiment of the present invention;

FIG. 8 is a cross-sectional view taken along line 8—8 of FIG. 7;

FIG. 9 is a partial cross-sectional view taken along line 9—9 of FIG. 7.

FIG. 10 is a schematic of the relative working thickness of both a fluid filled cushion or mattress and a fluid manifold;

FIG. 11 is a schematic of an individual laying on one embodiment of an immersion control device of the present invention;

FIG. 12 is a plan view of still another embodiment of the present invention;

FIG. 13 is a cross-sectional view taken along line 13—13

FIG. 14 is a cross-sectional view taken along line 14—14 of FIG. 12;

FIG. 15 is a cross-sectional view taken along line 15—15 of FIG. 14;

FIG. 16 is a cross-sectional view taken along line 16—16 of FIG. 14, and FIG. 17 is a schematic of a wheelchair incorporating the embodiment of the present invention shown in FIGS. 12-16.

Figure 1:
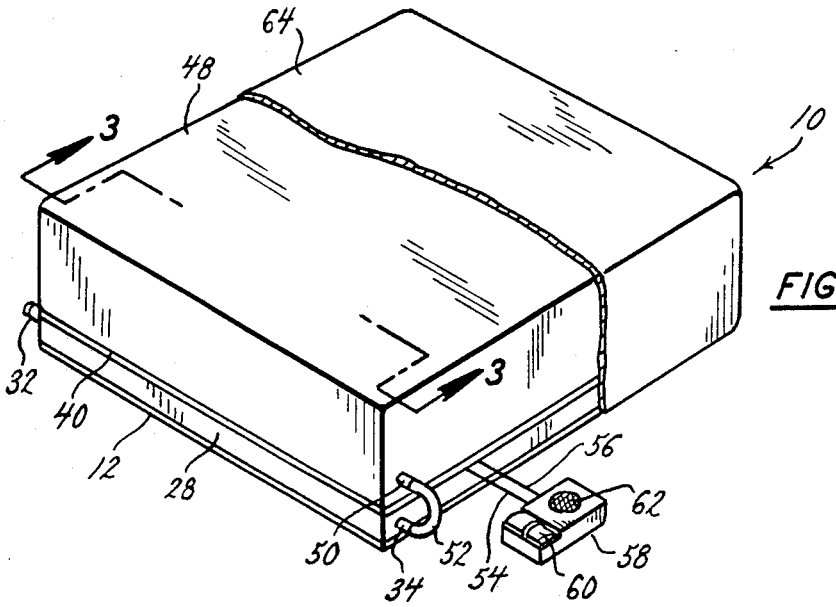
FIG. 1 is a perspective view of an embodiment of the device of the present invention.

DESCRIPTION OF THE PREFERRED EMBODIMENTS:

Referring now by characters of reference to the drawings, and first to FIG. 1, it will be understood that an immersion control device 10 generally includes a fluid manifold means and a fluid filled device such as a fluid filled cushion or mattress 48 in combination with an alarm.

Referring next to FIGS. 2-6 as well as FIG. 1, one embodiment includes a sensing means and a regulating means in which the regulating means includes a pair of regulating members, a regulating member 14 and another regulating member 16. The regulating members are supported by an upward facing surface 18 of a bottom mounting board 12. The regulating members can be a foam material, springs or any suitable spring-like material capable of maintaining a shape memory by returning to the original shape after compression.

The regulating members 14 and 16 have upward facing surfaces 20 and 22, respectively. A sensing means is provided including a first conductor and a second conductor. The first conductor includes one lower conductive member 24 carried by upward facing surface 20 and another lower conductive member 26 carried by the other upward facing surface 22. The second conductor includes upper conductive members 44 and 46 movable from a spaced apart position relative to the lower conductive members 24 and 26 to a position contacting the lower conductive members 24 and 26.

The fluid chamber manifold means generally includes a fluid manifold 28 which is supported on surface 18 of the board 12. Air will be the fluid referred to in the descriptions of the preferred embodiments of the present invention. It will be understood that other fluids, such as water, may also be used.

The chamber 28 includes one fluid communication opening 30 and an associated fluid supply and exhaust line connection 32. The fluid communication opening 30 in manifold 28 may be formed or reinforced by a fluid tight bushing. The chamber 28 includes another fluid communication opening 34 and another bushing providing the fluid tight opening 34.

The chamber 28 defines an aperture 36 and another aperture 38 for receiving regulating members 14 and 16, respectively as shown in the drawings.

An upper support member or top mounting board 40 is located above chamber 28 and has a bottom facing surface 42 facing the manifold. The one upper conductive member 44 and the other upper conductive member 46 are connected to bottom surface 42. Conductive members 44 and 46 are in cooperative registration with apertures 36 and 38, respectively, and lower conductive members 24 and 26, respectively.

The fluid filled cushion 48 is supported by the top mounting board 40 which is supported by the fluid manifold means. The fluid filled cushion or mattress 48 includes another fluid communication opening 50 including another fluid tight bushing. A fluid interconnecting means provides a fluid passage between the fluid filled support device, cushion or mattress and the fluid manifold means. In the described embodiment an interconnecting fluid line 52 provides a fluid passage between the fluid filled cushion or mattress 48 and the fluid chamber 28.

Alternatively, fluid communication between the cushion or mattress 48 and the fluid chamber 28 may be provided by fluid communication opening **34*a* in the manifold and fluid communication opening 50*a* in the fluid filled cushion or mattress with a fluid line 52*a*** and fluid tight bushings for a fluid tight interconnection. The alternative fluid communication provides an internal fluid passage between the fluid filled cushion and the fluid manifold.

In a preferred embodiment the fluid communication opening 30 and manifold fluid communication opening 34 or **34*a*** will not be located close together. By separating the openings the chance of a fluid short circuit between the openings will be greatly reduced.

In the described embodiment a lower conductive connecting means 54 and an upper conductive connecting means 56 are electrically connected to an alarm means 58. Preferably the connecting means 54 and 56 consist of electric wiring and the alarms means 58 includes either a visible annunciator 60, such as a light, or an audible annunciator 62, such as a horn, bell or buzzer, or both as illustrated. A battery operated alarm can be provided. The battery operated alarm provides for an alarm in the event of a power loss and allows mobile use of the system, for example, in association with a wheel chair.

A hygienic cover 64 can be used as a cover in hospital or nursing home environment. It is intended that a standard hygenic cover can be used. Little or no modifications will be required for the standard hygenic cover since the cushion or mattress and manifold combination of the present invention are intended to have nearly the same dimensions as either a standard wheelchair cushion or hospital bed cushion or mattress.

Referring next to FIGS. 4–6, it will be understood that another embodiment of the immersion control device of the present invention generally includes lower support means including a bottom mounting board 66 having a wall means including an upwardly directed peripheral wall 67. A fluid line notch 68 is provided in upwardly directed peripheral wall 67 for fluid line connection 32. Another notch 70 is provided in upwardly directed peripheral wall 67 to accomodate interconnecting fluid line 52.

Figure 2:
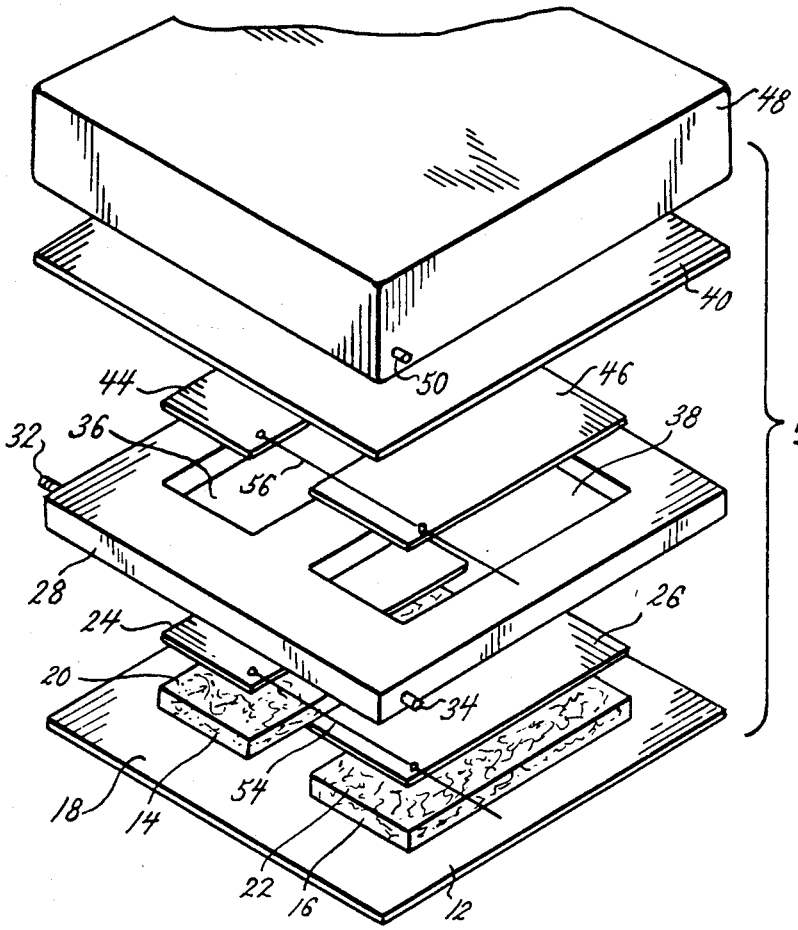

It will be understood that in the description of the embodiment shown in FIGS. 4–6 like reference characters refer to like structure in the preceding embodiment as shown in FIGS. 1–3.

An upper support means is provided movably connected to the lower support means and generally includes a top mounting board 72 having wall means including a depending peripheral wall 73. A notch 74 is provided in depending peripheral wall 73. Notches 68 and 74 cooperate during relative movement of the bottom and top mounting boards to provide a channel for the fluid line connection 32. The depending peripheral wall 73 includes another notch 76. The notch 76 cooperates with notch 70 during relative movement of the top and bottom mounting boards to provide an opening for the interconnecting fluid line 52. Likewise, wiring notch 78 in upwardly directed peripheral wall 67 cooperates with wiring notch 80 in depending peripheral wall 73 during relative movement of the bottom mounting board 66 and the top mounting board 72, so as to provide a channel for lower conductive wiring 54 and upper conductive wiring 56.

The upper and lower support means form a manifold chamber for the fluid manifold means. As in the previous embodiment a sensing means includes a plurality of spaced apart conductive members.

The embodiment of FIGS. 4–6 could also include alternative fluid communication openings **30*a* and 50*a* as previously discussed which would require an additional intermediate opening (not shown) in top mounting board 72. The embodiment of FIGS. 4–6** is particularly suitable for use as a solid seating base for a wheelchair.

Referring next to FIGS. 7–9, it will be understood that another embodiment of the immersion control device generally includes a fluid manifold 82 enclosing a regulating member 84. The regulating member can be a foam material, a spring or any suitable spring-like material capable of maintaining a shape memory by returning to the original shape after compression. In the description of the embodiment shown in FIGS. 7–9 like reference characters refer to like structure in the preceding embodiments as shown in FIGS. 1–6.

In this embodiment a sensing means includes a lower conductive member 86 connected to a regulating member 84 and an upper conductive member 88 connected to an upper inner facing surface of fluid manifold 82. The upper conductor 88 is spaced apart from the lower conductor 86. The upper conductor 88 is movable between its spaced apart position and a position contacting the lower conductor 86.

It is important to understand that in all of the preferred embodiments of the present invention relative movement of the spaced conductors is in response to a change in the fluid pressure within the immersion control device.

Wiring 90 is electrically connected to the upper and lower conductors. The wiring 90 passes through a fluid tight seal or bushing 92 as shown in FIG. 9. Wiring 90 connects the upper conductor 88 and the lower conductor 86 with the alarm means, as in the preceding embodiments, such that contact between the conductors will activate the alarm means.

The regulating members of the embodiments shown and described in FIGS. 1–3 and 7–9 provide a cushion in the event that the device malfunctions or leaks and a "bottoming out" occurs.

Referring next to FIGS. 12–17, it will be understood that another embodiment of the immersion control device generally indicated by reference character 200 includes a fluid filled device such as a fluid filled cushion 242 electrically and operationally connected to an alarm 201 similar to that shown and described with reference to the preceding embodiments. The immersion control device 200 also can be used as a solid seating base for a wheelchair as shown schematically in FIG. 17.

A lower support means is provided and includes a bottom support 202 with an upwardly directed peripheral wall 204. An upper support means is provided and includes an upper support 206 with a depending peripheral wall 208 and another depending wall 210 spaced inwardly from the depending wall 208.

The lower and upper support means define a manifold chamber 214. A fluid manifold 216 is located within the manifold chamber. It is intended that the fluid pressure will normally be sufficient to separate the lower and upper support means to maintain a channel 212 that extends from the outside to the inside of the manifold chamber 214, such that the upper support 206 does not "bottom out" on lower support 202.

A sensing means 218 is associated with the bottom support 202 and the upper support 206. The sensing means 218 generally includes one conductive sensing strip 220, another conductive sensing strip 222 and an intermediate conductive contact bar 224. It is intended that the contact bar be maintained in sliding conductive contact with conductive sensing strips 220 and 222, for example, by the use of spring-like conductors or other suitable resiliently flexible conductive members.

A fluid line connection 226 is connected to a fluid reservoir means, and the fluid manifold 216 and the fluid filled cushion or mattress 242 are connected by a fluid interconnecting line 228 including fluid tight bushings to provide a fluid tight interconnection.

Sensing means 218 includes interconnecting wiring 230 electrically connecting a plurality of conductive sensing strips 220, 222 and conductive contact bar 224 with alarm means 201 ad, if desired, a fluid reservoir 256, such as an air compressor and tank or other fluid reservoir and pump combination.

Four sensing means 218 are shown in FIG. 12. One sensing means will now be described and it will be understood that the other sensing means are generally identical to the one described.

As shown in the drawings, conductive sensing strips 220, 222 are connected to the depending peripheral wall 208. The conductive contact bar 224 is connected to the upwardly directed peripheral wall 204 so as to fit between the conductive sensing strips 220, 222. The conductive contact bar 224 maintains sliding contact with both conductive sensing strips 220, 222 and conductively completes a circuit between opposing spaced apart stages on strips 220, 222.

The conductive sensing strips 220, 222 can be divided into spaced apart conductive stages in order to provide a desired sequence of operation. In the described embodiment five spaced apart stages are shown and described. The number of spaced apart conductive stages will be provided as required for a particular application.

Each conductive sensing strip 220, 222 in the described embodiment includes five spaced apart stages. Each stage is spaced from adjacent stages by an insulated gap. The spaced apart stages shown are: inflate 232, stop 234, deflate 236, a blank 238 and off 240.

A schematic of a wheelchair 248 is shown in FIG. 17 and includes a fluid filled cushion 250 supported by a fluid manifold assembly 252 as hereinbefore described. A fluid line 254 is attached to a fluid reservoir 256 for pressurizing and de-pressurizing the fluid manifold 216 located within fluid manifold assembly 252. The fluid manifold assembly 252 includes the bottom support 202 and the upper support 206 as previously described. The fluid reservoir and pump combination 256, a battery 260 and the alarm means 201 are electrically and operatively connected by sensing means wiring 254, located outside of the manifold assembly 252 and identified by reference character 258. The embodiment of the immersion control device shown and described in FIGS. 4–6 may be substituted for the embodiment 200 in FIG. 17.

Depending upon the source of fluid and whether pressure regulator means are used in a given application of the present invention, it may be necessary to provide a check valve, shut-off valve, or both. For example, a check valve allowing flow into the fluid manifold may be placed in parallel with a shut-off valve in the fluid supply and exhaust line. The shut-off valve provides a by-pass around the check valve with means to decrease the fluid pressure as needed. Furthermore, depending upon the sophistication of a particular embodiment, the shut-off valve can be electrically operated for remote activation. The shut-off valve could also be manually operated. This valving and fluid line combination can also be applied to the previously described embodiments as well.

The fluid manifold assembly 252 includes a plurality of notches in the interfitting, depending walls and upwardly directed walls for passage of the fluid supply and exhaust line 226 and the fluid interconnecting line 228 out from the fluid manifold 216 in the manifold chamber 214. The notches are shown, for example, in FIG. 13 including one of two depending peripheral wall notches 244 and an upwardly directed wall notch 246.

In operation the embodiments shown in FIGS. 1–9 include the fluid manifold 28 positioned below the fluid filled cushion or mattress 48 and the interconnecting fluid line 52 attached thereto. An individual is positioned on the fluid filled cushion or mattress 48. The weight of the individual establishes an initial fluid operating pressure which can be increased or decreased in order to establish a fluid pressure that results in a desired immersion depth.

As the fluid pressure within the fluid filled cushion or mattress increases or decreases as a result of a change in static weight or weight distribution on the fluid filled cushion or mattress the fluid pressure within the fluid manifold will also increase or decrease. The fluid pressure in the cushion or mattress will always be equal to the fluid pressure in the manifold notwithstanding the fluid volume of either the cushion or mattress or the manifold.

As the fluid pressure increases or decreases the regulating members change from either a compressed (or low) condition or a non compressed (or high) condition. Movement of the regulating members translates to a desired immersion depth in the fluid filled cushion or mattress. A desired dimension "X" corresponds to a distance slightly greater than the thickness of the regulating members. The immersion control device will transfer the dimension "X" to the cushion or mattress independent of the fluid volumes of the cushion or mattress and the manifold since the fluid pressure in the manifold always equals the fluid pressure in the cushion or mattress. When the desired "X" dimension is achieved the electrical conductors connected to the regulating members should open the electrical circuit connected to the alarm and/or means of pressure regulation.

In one possible operation sequence, for example a minute air leak, a decrease in fluid pressure results in an increase in immersion depth. The dimension "X" decreases until it is equal to or less than the thickness of the regulating member or members which will result in contact between upper and lower conductors and will activate the alarm. The fluid pressure within the fluid manifold must then be increased to increase the dimension "X" in order to stop the alarm and again provide the individual with the desired immersion depth.

In operation, the embodiments illustrated in FIGS. 1–9 require first that a fluid pressure be established that provides a desired maximum immersion depth into a fluid support device corresponding to a desired supporting thickness "X", as represented schematically in FIG. 10. This dimension is determined by the thickness of regulating members 14, 16 or 84. The immersion control device detects a decrease or increase in the established fluid pressure and a change in weight distribution. As the fluid pressure in the immersion control device decreases the conductive members move from their spaced apart positions until the fluid pressure decreases sufficiently that the conductive members touch and sound an alarm and activate a circuit that can, if desired, increase the pressure through a pressure regulator means, such as an air compressor. Thus, once the drop in fluid pressure or a change in weight distribution is detected steps can be taken to alleviate the course of the fluid pressure drop and re-establish the fluid pressure that provides the desired immersion depth either manually or automatically with a pump.

As illustrated schematically in FIG. 11, it will be understood that in a reclining position (as shown) or a sitting position (such as in a wheelchair), as shown in FIG. 10, the weight distribution and weight on the fluid filled cushion or mattress can vary as an individual shifts, leans or turns. Therefore, it is generally recommended to establish a desired immersion depth with the individual immersed as deeply as possible in the fluid filled support device. Thus, the weight distribution that normally causes the minimum skin pressure also has the maximum immersion depth and the maximum amount of surface area of skin or support area that is contacted by the fluid filled cushion or mattress.

If there is an over-pressure condition then fluid pressure in the immersion control device must be decreased until the desired immersion depth is again obtained. If the alarm sounds, then the fluid pressure has been decreased too much and requires a readjustment.

Relatively heavy individuals will require greater fluid pressure to achieve the desired immersion depth and similarly relatively lighter individuals will require less fluid pressure to achieve the desired immersion depth. In the embodiment illustrated in FIGS. 12–17 this fluid pressure adjustment can be accomplished automatically.

In operation, the embodiment illustrated in FIGS. 12–17 includes a relatively sophisticated sensing means but operates similarly to the embodiments of FIGS. 1–9. A fluid pressure is established that provides a proper or maximum immersion depth corresponding to a minimum skin pressure and a maximum amount of surface area of skin or support area that is contacted by the fluid filled device. This corresponds to a desired supporting thickness "X" and corresponds to conductive contact bars 224 located intermediate opposing conductive stages 234. The immersion control device maintains the fluid pressure by increasing or decreasing the fluid pressure as required and as indicated by the position of the conductive contact bars as they move between the spaced apart stages to provide a feedback signal to the alarm means, fluid reservoir, pressure regulator means, valve means associated with the supply and exhaust line or a combination thereof as previously described. Feedback systems suitable for use in the present invention are known to those skilled in the art.

In the embodiment of the immersion control device shown in FIGS. 12–17 if the upper support attempts to "bottom out" then the conductor bars 224 complete an electrical circuit at intermediate opposing stages 232 and the alarm will be activated.

Due to the inclusion of two or more spaced apart stages an audible alarm can be provided that will indicate by variance in pitch or other means that the upper support 206 is in the "bottomed out" position (too little fluid pressure) or if there is less than the desired immersion depth (too much fluid pressure, stage 236). Preferably, when desired immersion depth has been obtained (i.e., stage 234) there will be no alarm. It will be understood that instead of or in addition to the audible alarm, a light or series of lights or a variable intensity light, for example, can be provided in association with the alarm means.

It will be further understood that the more sophisticated embodiment including the five spaced apart stages, automatically adjusts the fluid pressure in the fluid manifold and mattress or cushion as weight distribution changes.

In the described embodiment it will be understood that addition of the blank stage 238 and the thickness of stages 232, 234 and 236 can reduce "hunting" and "short cycling" of the fluid reservoir. It will be further understood that the thickness of the stages can be determined to match the performance characteristics of the fluid reservoir, pressure regulator means (pumps, etc.) and the alarm means in order to reduce or eliminate "hunting" and "short cycling", problems commonly associated with feedback systems.

The alarm means can be connected to the fluid reservoir so that the fluid reservoir pressure can be automatically increased and decreased in response to a signal from the alarm means.

Additional stages can be added. The additional stages can be used to provide more than one level of immersion. In the case of non-paralyzed user, this would allow the user to pre-select a desired immersion depth and therefore the level of comfort provided, such as a softer (deeper immersion) or harder (shallower immersion) support. The present invention is particularly adaptable for use with an automobile, truck or airplane seat or other seat or support in which an individual must remain for an extended time.

From the foregoing description those skilled in the art will appreciate that all of the aspects of the present invention are realized. An immersion control device has been shown and described for providing the desired immersion depth for an individual or object supported by a fluid filled support device such as a mattress or cushion. The desired immersion depth ensures minimum supporting contact pressure and maximum supporting contact area between the fluid filled cushion or mattress and the individual or object. Immersion depth depends on fluid pressure and not the fluid volume of either the fluid filled cushion or mattress or the fluid manifold. The fluid manifold is preferably a flexible or expandable material such as a rubber or vinyl material. An alarm means has been provided that either passively signals a fluid pressure condition or operates as part of a feedback system through a fluid pressure regulator associated with the fluid reservoir to automatically adjust the fluid pressure to again achieve the desired immersion depth. Furthermore, the spaced apart conductive members or stages in the described embodiments have included either a conductive film or conductive strips and conductive bars.

While four embodiments generally have been shown and described, many variations are possible. For example, the immersion control device can be used to provide comfortable, adjustable seating as part of an automobile seat cushion. The device can be used to support objects which are too fragile, expensive or volatile to be protected by normal packaging methods.

Other modifications may be made to the embodiments illustrated and described without departing from the spirit of the invention. It is not intended that the scope of this invention be limited to a particular embodiment. Rather, the scope of the invention is to be determined by the following claims and their equivalents.

What I claim is:

1. An immersion control device comprising:
(a) a fluid filled support device,
(b) fluid chamber means located below and in a generally supporting relationship with the fluid filled support device,
(c) fluid interconnecting means providing a fluid passage between the fluid filled support device and the fluid chamber means,
(d) sensing means for sensing a fluid pressure change within the support device and the fluid chamber means, the sensing means including:
1. a first conductor,
2. a second conductor, and
3. at least one of the first conductor and the second conductor movable between a spaced apart position and a contacting position, wherein the movement of either or both the conductors is in response to the change in fluid pressure within the immersion control device.

2. An immersion device as set forth in claim 1, further comprising:
(e) a fluid pressure regulator means for regulating fluid pressure thereby maintaining the first conductor and the second conductor in a desired spaced apart position.

3. An immersion control device as set forth in claim 1, further comprising:
(e) alarm means electrically connected to the sensing means.

4. The device as set forth in claim 1, further comprising:
(e) alarm means electrically connected to the sensing means and responsive to a change in weight distribution or fluid pressure in the immersion control device.

5. The device as set forth in claim 1, in which:
(e) sensing means for sensing the change in the fluid pressure is responsive to a fluid pressure change in the immersion control device, and includes:
1. a regulating member,
2. at least two opposing conductive members movable between a spaced relationship and a contacting relationship, one conductive member connected to the regulating member and another conductive member operatively connected to the fluid chamber means.

6. The device as set forth in claim 1, further comprising:
(e) a combined fluid supply and exhaust connection for the fluid chamber means, and
(f) a fluid reservoir connected to the fluid connection, the fluid reservoir responsive to the sensing means, whereby fluid pressure in the immersion control device will be changed through the fluid supply and exhaust connection in response to the sensing means so as to provide a desired fluid pressure.

7. The device as set forth in claim 1, in which:
(e) the fluid chamber means includes a fluid chamber defining a pair of apertures,
(f) one regulating member received within the one of the apertures, the one regulating member including an upwardly facing surface,
(g) another regulating member received within another one of the apertures, the other regulating member including another upwardly facing surface,
(h) a lower conductive film member carried by one regulating member upper facing surface,
(i) another lower conductive film member carried by the other regulating member upper facing surface,
(j) a bottom support member supporting both of the regulating members and the fluid chamber,
(k) an upper support member located intermediate the fluid filled device and the fluid chamber and operatively supporting an upper conductive film member in opposing relationship with the one lower conductive film member and another upper conductive film member in opposing relationship with the other lower conductive film member, and
(l) electrically connecting means electrically connecting lower conductive film members and upper conductive film members with an alarm means.

8. An immersion control device comprising:
(a) lower support means for supporting a fluid chamber,
(b) upper support means movably connected to the lower support means, the lower support means and upper support means defining a fluid chamber enclosure, the upper support means supporting a fluid filled device, (c) wall means, the wall means in cooperative relationship so as to allow relative movement between the lower support means and the upper support means, the relative movement generally limited to movement of the support means toward and away from each other, (d) fluid chamber means, the fluid chamber means located within the fluid chamber enclosure, (e) a fluid interconnecting means providing a fluid tight passage between the fluid chamber means and the fluid filled device, (f) means for sensing a change in fluid pressure, the sensing means connected to the lower support means, the upper support means and the wall means, and (g) the sensing means including a plurality of spaced apart conductive stages.

9. The device as set forth in claim 8, further comprising:

(h) alarm means electrically connected to the sensing means and responsive to a change in the fluid pressure in the immersion control device.

10. The device as set forth in claim 8, further comprising:

(h) a fluid supply and exhaust connection associated with the fluid chamber means, (i) a fluid reservoir responsive to the sensing means, whereby fluid pressure can be regulated through the fluid supply and exhaust connection in response to the sensing means.

11. The device as set forth in claim 8, wherein:

(h) the sensing means includes a plurality of conductive sensing strips, each sensing strip having two or more conductive strips, and (i) a contact bar means in sliding electrical contact with the sensing strips.

12. An immersion control device comprising:

(a) a fluid filled support device for maintaining a desired depth of immersion for supporting a weight of a person or object, the desired depth of immersion corresponding to a fluid pressure, the fluid filled support device having one fluid volume, (b) a fluid chamber means having another fluid volume, the fluid chamber means in supporting relationship with the fluid filled support device, (c) a sensing means for sensing fluid pressure within the fluid chamber means and the fluid filled support device, and (d) the fluid filled support device fluid pressure equal to the fluid chamber means fluid pressure independent of any difference between the one fluid volume and the other fluid volume.

13. The immersion control device as set forth in claim 12, in which:

(e) the device includes a wheelchair cushion.

14. The immersion control device as set forth in claim 12, in which:

(e) the device includes a fluid filled cushion or mattress suitable for use in a bed.

15. A method of providing a determined immersion depth in an immersion control device, comprising the steps of:

(a) providing a fluid filled support device for supporting an individual or an object, (b) providing a fluid filled chamber means connected to the fluid support device such that fluid pressure in the fluid filled support device is equal to fluid pressure in the fluid chamber means independent of the fluid volumes of either the fluid filled support device or the fluid chamber means, (c) determining a desired immersion depth for the individual or object supported by the fluid filed support device, the desired immersion depth corresponding to a desired fluid pressure within the immersion control device, (d) connecting a sensing means to the fluid chamber means to respond to a fluid pressure change, (e) the sensing means sensing the fluid pressure change in the fluid chamber means, the fluid pressure change correlating to a corresponding change in the immersion depth of the object or individual supported by the fluid filled support device, and (f) locating the fluid chamber means in a supporting relationship with respect to the fluid filled support device.

* * * * *